United States Patent [19]

Fairbanks

[11] 3,958,768

[45] May 25, 1976

[54] PACKAGE OF GUSSETED BAGS ON A ROLL

[75] Inventor: Donald M. Fairbanks, Sacramento, Calif.

[73] Assignee: Mobil Oil Corporation, New York, N.Y.

[22] Filed: Oct. 15, 1975

[21] Appl. No.: 622,549

[52] U.S. Cl. ..... 242/1; 206/225; 206/390; 206/391; 206/409; 221/25; 229/17 S; 242/55.53

[51] Int. Cl.[2] ..... B65D 85/671

[58] Field of Search ..... 221/25, 69, 70, 71, 221/72, 73, 74; 229/17 S; 206/225, 233, 390, 391, 393, 394, 395, 396, 409, 485, 493; 242/1, 55.53

[56] References Cited

UNITED STATES PATENTS

| | | | |
|---|---|---|---|
| 2,341,368 | 2/1944 | Flood | 221/73 |
| 2,771,214 | 11/1956 | Lefebure | 221/25 |
| 3,001,643 | 9/1961 | O'Meara et al. | 206/409 |
| 3,051,583 | 8/1962 | Tindall | 206/409 |
| 3,144,970 | 8/1964 | Beschmann | 206/395 |
| 3,674,135 | 7/1972 | Simon | 206/225 |
| 3,682,051 | 8/1972 | Sengewalo | 229/69 |

*Primary Examiner*—William Price
*Assistant Examiner*—Bruce H. Bernstein
*Attorney, Agent, or Firm*—C. A. Huggett

[57] ABSTRACT

Smearing of graphics and scoring of gusseted bags on a roll during dispensing from a shipping, storage and dispensing container are inhibited by providing support in the container for that roll only at the margin and between the margin and the thickened portion at the inner fold of the gusset but not including such thickened portion.

4 Claims, 8 Drawing Figures

FIG. 4
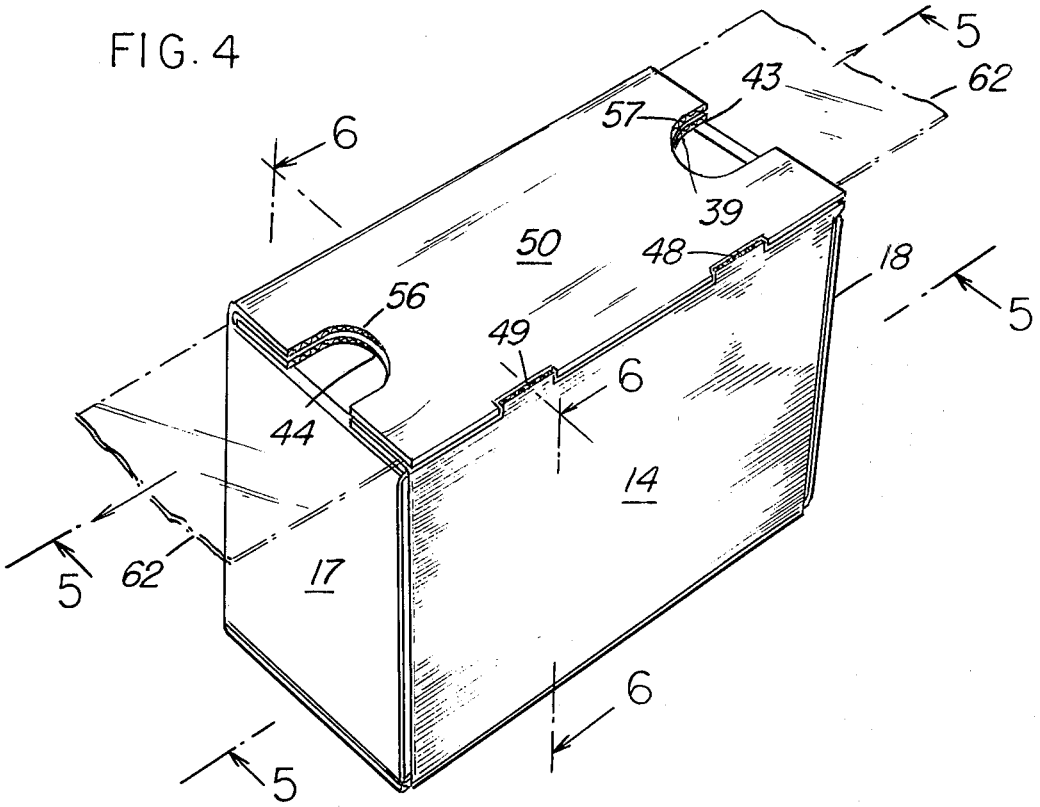
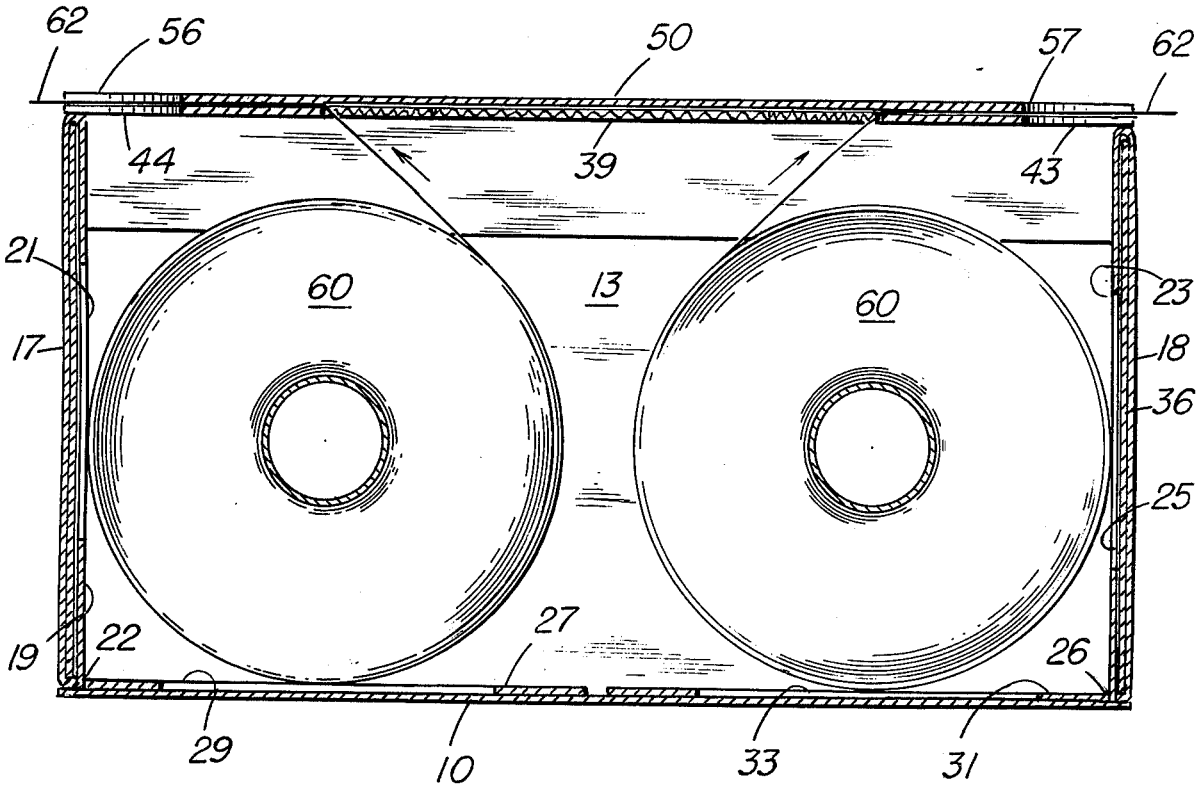
FIG. 5

PACKAGE OF GUSSETED BAGS ON A ROLL

BACKGROUND OF THE INVENTION

Bags of thermoplastic film are widely used for various purposes. A common method of supplying such bags is on a roll in which the line or division between successive bags is perforated for easy detachment of individual bags. Frequently the roll of bags is mounted on a spindle for free rotation, giving rise to the risk of unrolling an excessive number of bags when one bag is detached by a sudden jerk.

A type of bag which presents the problem in exaggerated form is provided with gusseted sides. Such bags are prepared from a tube of thermoplastic film by folding a portion of the film inwardly on opposite sides, flattening the tube with its folds and sealing across the end intended to be bottom of the bag. Perforations to provide for detachment are a line spaced a short distance from the line of seal. The perforation line is through four layers of film to the extent of the gusseted sides and is therefore more resistant to detachment by a suddenly applied force.

Gusseted bags are now widely used for such purposes as "wet-pack" at supermarket checkout counters. In such uses, goods which have moisture accumulated on the surface or which tend to accumulate moisture by condensation, such as ice cream, are placed in thermoplastic film bags to protect the main packing bag and other goods packed with them. For these and other purposes it is desirable to have attractive graphics applied to the individual bags by printing while the bags are in the forming machinery.

Some of the difficulties heretofore enumerated can be relieved in part by packing the gusseted bags on a roll in a cardboard carton. It is found that, when so packed, the bags become scuffed and the graphics are smeared as the roll rotates against the bottom and sides of the carton. This difficulty occurs primarily at the ridge formed about the roll where the extra thickness occurs by reason of the inner fold of the gusset. This causes the roll to make contact with the carton along a very small area of the bag, almost line contact.

SUMMARY OF THE INVENTION

The foregoing difficulties are eliminated by using a box in which rails are provided along the sides of the packing box of such dimensions that they support the roll only on those parts of the gussets other than the inner fold. Preferably, the carton is also provided with means to frictionally engage the bags as withdrawn from the roll. This acts as a brake against which the individual bags are readily detached by a sudden pulling force. The brake also inhibits retraction of bags back into the carton.

DESCRIPTION OF THE DRAWINGS

Structures to accomplish the foregoing purpose are shown in the annexed drawings wherein

FIG. 4 is a perspective view of the package after closure of the top panels and showing the ends of bags on a roll projecting from suitable openings in the top of the package.

FIG. 5 is a section on line 5—5 of FIG. 4;

DESCRIPTION OF PREFERRED EMBODIMENTS

Figure 1:
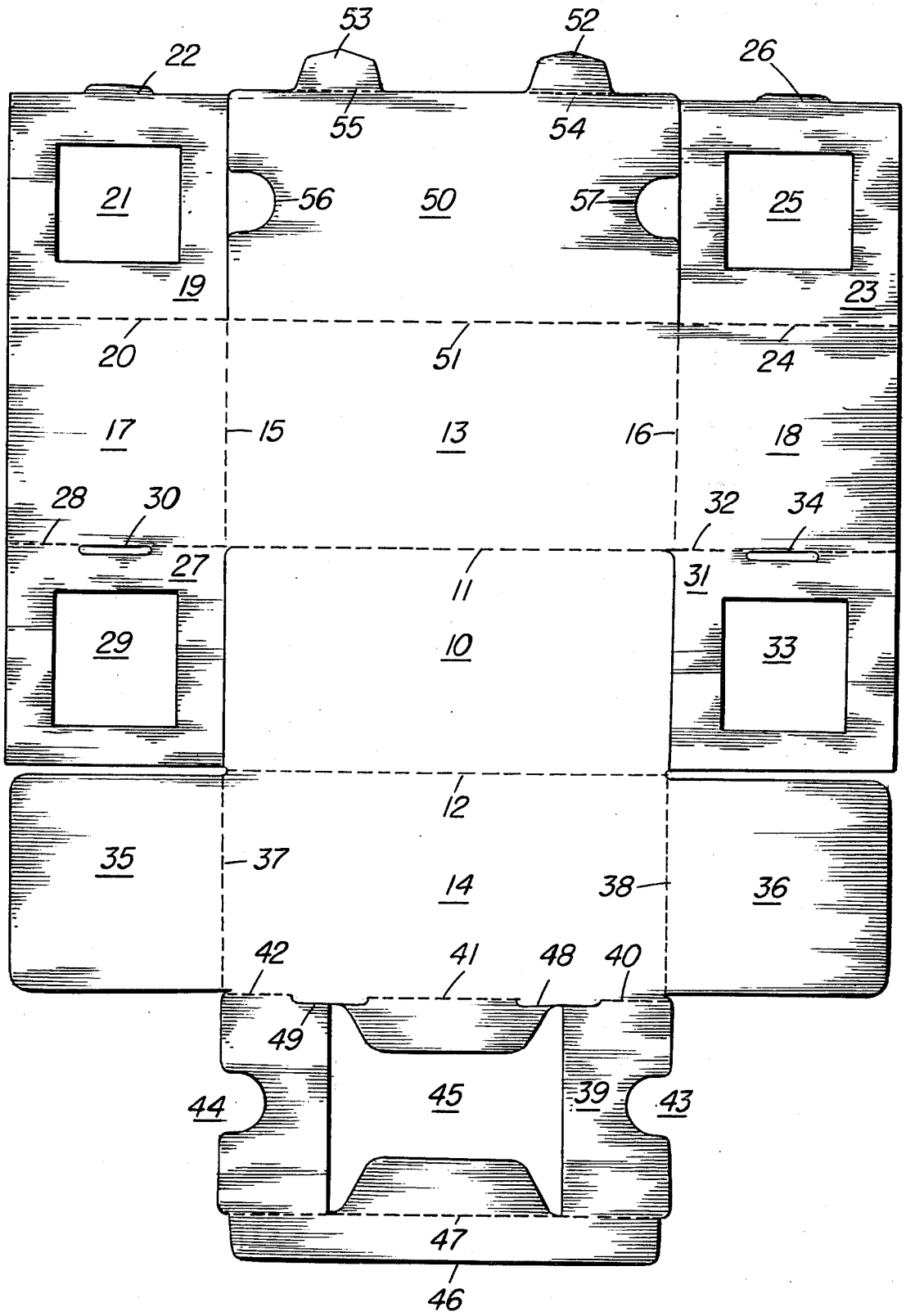
FIG. 1 is a box blank cut from corrugated cardboard such that a unitary blank may be folded to provide the package of this invention.

According to a preferred embodiment of the invention shown in FIG. 1, the novel package may be prepared by cutting, folding and inserting integral tabs from a single sheet of suitable stock, such as corrugated cardboard. The blank box in FIG. 1 is cut and scored for folding to provide a bottom panel 10, joined along score lines 11 and 12 to side panels 13 and 14, respectively. Side panel 13 is joined at score lines 15 and 16 to outer end panels 17 and 18, respectively. The outer end panels carry track panels to provide support by the box at the bottom thereof and at the ends thereof adjacent dispensing ports of that part of a roll of gusseted bags which includes the thickened portion due to gussets, but not the inner margin of such thickened portion.

An end track panel 19 meets outer end panel 17 along score line 20. A central rectangular portion of track panel 19 is cut out as indicated at 21 to leave the desired raised track elements. A tab 22 is provided on end track panel for latching engagement with a slot presently to be described. A like end track panel 23 is similarly joined to outer end panel 18 at score line 24 and is formed to provide cut-out portion 25 and tab 26. At the side of outer end panel 17 remote from end track panel 19 is a bottom track panel 27, joined to end panel 17 along score line 28. A rectangular cut-out portion 29 in bottom track panel 27 is formed as shown. A die-cut slot 30 in panel 27 adjacent score line 28 is adapted to receive tab 22 on panel 19 in latching relationship. Similarly, a bottom track panel 31 joins outer end panel 18 along score line 32. Cut-out portion 33 and slot 34 correspond in function to like features 29 and 30 of panel 27.

Turning now to side panel 14; this element carries inner end panels 35 and 36, joined along score lines 37 and 38, respectively. Panel 14 is also joined to an inner top panel 39 along score lines 40, 41 and 42. As shown, inner top panel 39 has semi-circular end cut-outs 43 and 44 and a central cut-out 45. The latter, central cut-out 45, provides for feed from rolls of bags over the inner top panel 39. A closure tongue 46 is joined to inner top panel along score line 47. Die-cuts 48 and 49 along the edge of inner top panel 39 provide closure slots for a purpose presently to be described upon folding inner top panel along score lines 40, 41 and 42.

Turning now to the opposite side of the blank, outer top panel 50, joins side panel 13 at score line 51. Outer top panel 50 carries closure tabs 52 and 53, joined thereto along score lines 54 and 55, respectively. The closure tabs 52 and 53 are adapted to enter the slots provided by die-cuts 48 and 49 when the inner top panel 39 is folded on score lines 40, 41 and 42. Semi-circular cut-outs 56 and 57 provide discharge ports for dispensing contents from rolls in the package by passage through the central cut-out 45 of inner top panel 39; thence between inner top panel 39 and outer top panel 50 and through the port provided by semi-circular cut-out 56 or 57.

It will be seen from disclosure below that this blank, cut from a single sheet in one operation is erected to a storage and dispensing container which serves multiple functions of (1) making the next bag of a contained roll conveniently available upon detachment of the preceding bag; (2) acting as a brake to inhibit accidental displacement back into the box of a bag so placed for availability; and (3) providing tracks which cause a contained roll of gusseted bags to make contact with box surfaces only on the gusseted portions of bags with those surfaces of the container frictionally contacted thereby.

The operation of erecting, loading and closing the package begins by rotation inwardly of outer end panels 17 and 18 through an angle of 90° about score lines 15 and 16, followed by rotation inwardly of bottom track panels 27 and 31 through a 90° angle about score lines 28 and 32. Side panel 13 is then rotated through an angle of 90° to place bottom track panels 27 and 31 superposed on bottom panel 10. End track panels 19 and 23 have not been rotated relative to outer end panels 17 and 18 at this stage and now project upwardly above the partially erected box.

Figure 2:
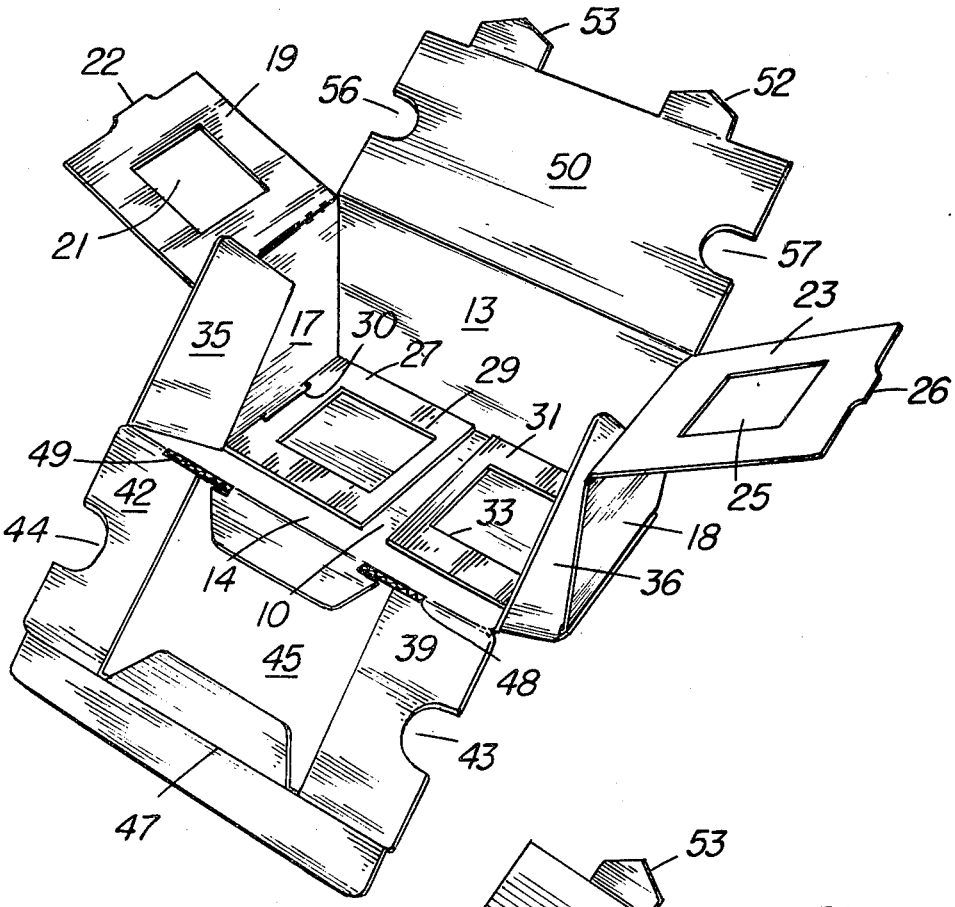
FIG. 2 shows the box partially erected.
Figure 3:
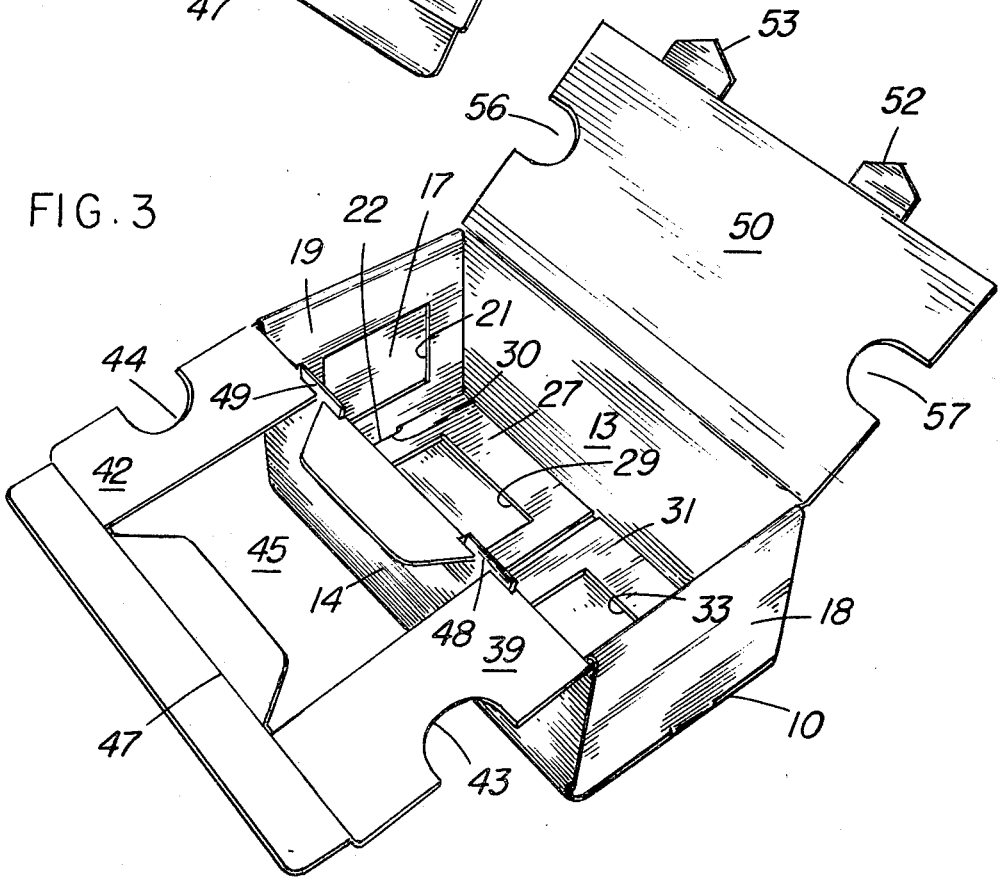
FIG. 3 is the box in fully erected form with top panels open.

As the next step, inner end panels 35 and 36 are rotated 90° about score lines 37 and 38 whereupon side panel 14 is rotated inwardly about score line 12 while retaining inner end panels within the box such that inner and outer end panels are in contact as indicated in FIG. 2. When this operation is completed, end track panels 19 and 23 are rotated 180° about score lines 20 and 24, respectively, causing tabs 22 and 26 to engage in slots 30 and 34, thus effectively locking the box structure to a container of great strength and inherent integrity, as shown in FIG. 3.

The open top box is next loaded with two like rolls of gusseted bags 60, arranged such that bags are drawn from the rolls at the sides thereof adjacent each other. See FIGS. 4, 5 and 6. The rolls 60 thus rest on bottom track panels 27 and 31. The action of drawing bags from the rolls causes the rolls to rotate in frictional engagement with the bottom track panels 27 and 31 and the end track panels 19 and 23. Those track panels are cut out in such manner as to so frictionally engage the rolls 60 only on the portions thereof outside the inner fold of the gussets, whereby there is no contact of the box with a heavy full roll at the ridge 61 in that roll due to the inner fold lines of the gussets.

The box with two contained rolls is now closed in two steps. Inner top panel 39 is rotated into position over the top of the box with closure tongue 46 adjacent the inner surface of side panel 13 and the free ends 62 of the rolls 60 are drawn through central cut-out 45 of panel 39, and across inner top panel 39 to the outside of the box, the lead bags for each roll 60 being drawn over the ends of the box respectively near each roll. It will be seen that rotation of inner top panel 39 about score lines 40, 41 and 42 causes slots to be formed by side panel 14 and the edges of die-cuts 48 and 49. These are now utilized when outer top panel 50 is rotated into superposed position over inner top 39 and the closure tabs 52 and 53 are inserted to those slots. The lead ends from the rolls 60 now lie between inner top panel 39 and outer top panel 50, projecting beyond the ends of the box for dispensing in a gathered "strand" through semi-circular cut-outs 56 and 57, respectively. This finished package is illustrated in FIG. 4.

As bags are desired, for example in wet packaging at a supermarket check-out counter, the free end is drawn from either end of the packaged bags on a roll against frictional resistance between the inner and outer top panels 39 and 50 until a complete bag is exposed. The same is then removed by tearing at the perforations between bags and used as desired. That operation has drawn the next bag into dispensing position. The possibility that movement of the roll in the box, shock or other cause will retract that next bag from dispensing position is effectively resisted by the friction against the train of bags between inner and outer top panels 39 and 50; while smearing of printed graphics or scoring is inhibited by the lack of contact of the box with the roll at the areas of maximum density due to the inner folds of the gussets.

Figure 6:
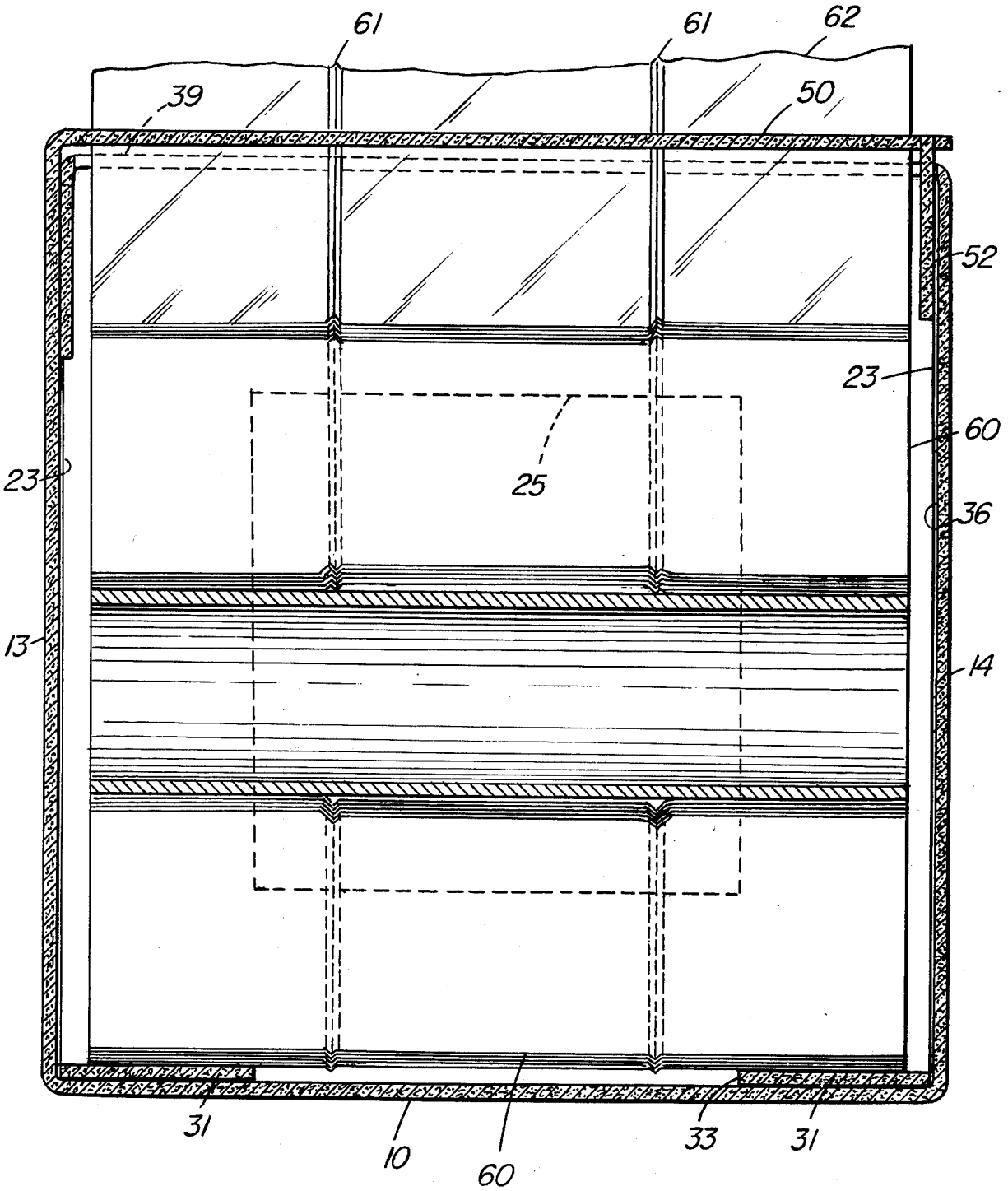
FIG. 6 is a section on line 6—6 of FIG. 4.

The manner in which the rolls 60 are supported by the rails of track panels 27 and 31 will be apparent from FIGS. 5 and 6. The entire weight of the roll is carried by the rails of the track panels leaving the ridges 61 unsupported and also leaving the spaces between ridges 61 unsupported.

It will be seen that the unrolling action as bags are withdrawn will cause the roll to contact the end of the package. To inhibit smearing of graphics and scoring of the film, the rails provided by track panels 19 and 23 are such that they contact the rolls only on the gusseted portions of the bags outward of the ridges 61.

Figure 8:
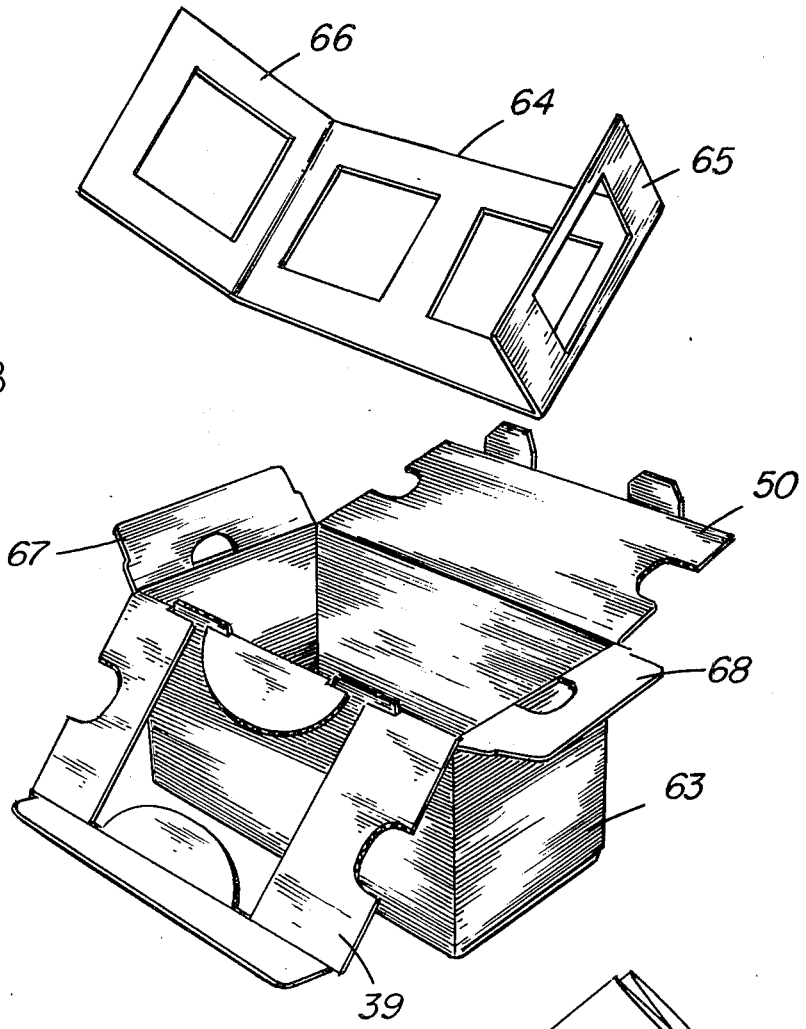
FIG. 8 is an exploded view of the elements in a modified form of the invention.

Similar effects may be obtained with the embodiment of the invention illustrated in FIG. 8. A box 63 of conventional structure, except for the closure means, is modified by insertion of an element 64, formed to provide track panels apart from the box blank itself. Upon folding end track panels 65 and 66 to vertical position, the element 64 is then inserted to the bottom of the box to provide rails of essentially the same nature as those provided by the blank of FIG. 1.

The closure means for the package of FIG. 8 includes an inner top panel 39 and an outer top panel 50 similar to those of the blank in FIG. 1 and bearing like reference numerals. With such a carton, it is preferable to include end top flaps 67 and 68 as shown in FIG. 8.

The embodiment of FIG. 8 provides possibility for alternative arrangements for withdrawal of bags under frictional restraint. The train of bags may be withdrawn between inner top panel 39 and outer top panel 50 as in the embodiment first described. A lesser degree of friction is applied if the train of bags is withdrawn between end top flap 67 or 68 and outer top panel 50.

Figure 7:
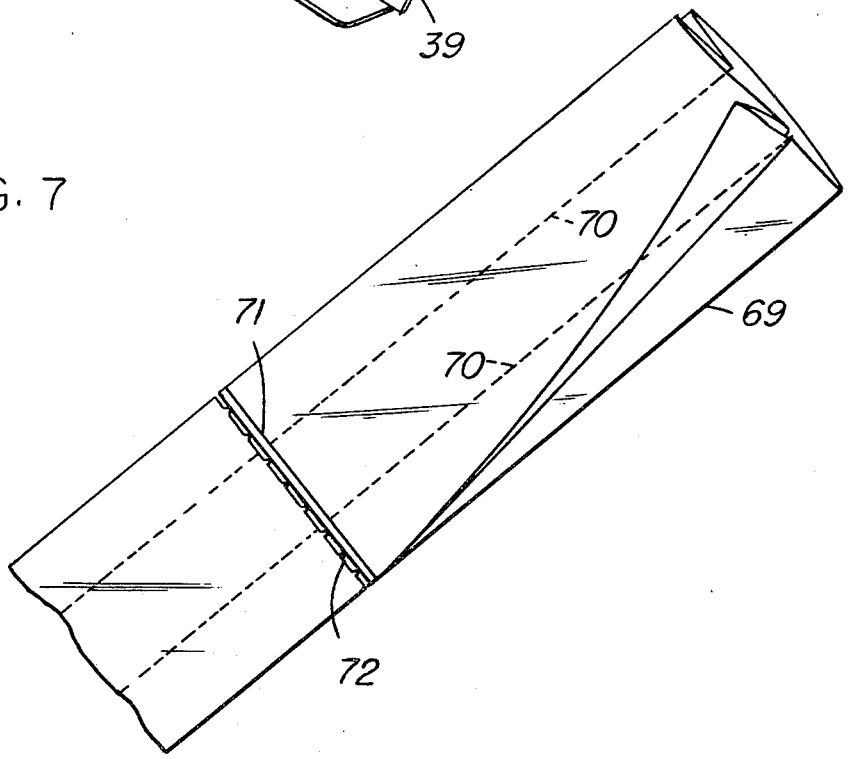
FIG. 7 is a typical gusseted bag showing connection to a fragment of the next following bag in a roll.

The structure of individual bags and manner of attachment in a roll are illustrated in FIG. 7. The sides of the bag are folded inwardly along edges 69 to provide an interior fold 70. The resultant gusset opens when the bag is filled. Bottom of the bag is formed by sealing across the gusseted tube, as by heat seal 71 through all layers of film, including that in the gussets. The continuation of film to the next bag is perforated along line 72 to provide a fangible junction, strong enough to withstand drawing bags from the package, but parting when subjected to sudden, sharp pulling stress.

I claim:

1. A package of gusseted bags on a roll adapted for protection of the bags during shipping, storage and dispensing and for convenience of dispensing which comprises:

a. a rectangular box having a bottom wall and four side walls operatively connected with each other to define a container and top closure means connecting said side walls, said box having a dispensing opening for dispensing bags adjacent the juncture of said top closure means and at least one of said side walls;

b. parallel side rail members extending along said bottom adjacent opposing side walls perpendicular to the wall adjacent said dispensing opening to terminate at edges spaced from the respective adjacent walls;

c. a roll of flattened gusseted bags supported on said side rail members and arranged in said box for dispensing bags from said roll through said dispensing opening; each of said bags having sides inwardly folded to a width less than half the flattened width of the bag, being sealed across the gussets at one end and frangibly connected at the other end to a like bag adjacent the sealed end thereof, whereby said roll has greatest diameter at the inner folds of said bags;

d. the said edges of said side rail members being spaced from adjacent walls by a distance less than the said width of inner folds of said bags, whereby said rolls are unsupported at said greatest diameter.

2. A package according to claim 1 having two said openings adjacent opposite walls thereof.

3. A package according to claim 1 wherein said top closure means comprises an inner top panel and an outer top panel; the inner top panel having a central opening and the outer top panel being formed to provide said dispensing opening spaced from said central opening, whereby bags being dispensed from said roll are subjected to frictional restraint between said panels.

4. A package according to claim 1 wherein parallel rail members extend along the side wall adjacent said dispensing opening.

* * * * *